US006514457B1

(12) United States Patent
Rhiger et al.

(10) Patent No.: US 6,514,457 B1
(45) Date of Patent: Feb. 4, 2003

(54) EXTRACTION OF IMPURITIES FROM STRUCTURES CONTAINING MERCURY, CADMIUM, ZINC, OR TELLURIUM, AND IMPURITIES

(75) Inventors: David R. Rhiger, Santa Barbara, CA (US); Sanghamitra Sen, Ventura, CA (US)

(73) Assignee: Raytheon Company, Lexington, MA (US)

( * ) Notice: Subject to any disclaimer, the term of this patent is extended or adjusted under 35 U.S.C. 154(b) by 47 days.

(21) Appl. No.: 09/771,396

(22) Filed: Jan. 25, 2001

(51) Int. Cl.[7] ..... C21B 7/00
(52) U.S. Cl. ..... 420/590
(58) Field of Search ..... 438/476; 420/590

(56) References Cited

U.S. PATENT DOCUMENTS 6,143,630 A * 11/2000 Tregilgas ..... 438/476

OTHER PUBLICATIONS

M. Astles, et al., "The user of In–Situ Wash Melts in the LPE Growth of (CdHg)Te," *J. Crystal Growth*, vol. 80 (1987), pp. 1–8.

Sanghamitra Sen, "Extraction of Mobile Impurities from CdZnTe", 1999 U.S. Workshop on the Physics and Chemistry of II–VI Materials (1999), pp. 1–9, Figure Captions, and Figures 1–7, No month.

* cited by examiner

*Primary Examiner*—Melvyn Andrews
(74) *Attorney, Agent, or Firm*—William C. Schubert; Glenn H. Lenzen, Jr.

(57) ABSTRACT

Impurities are extracted from a thin-film device structure based on mercury, cadmium, zinc, and/or tellurium, such as HgCdTe, CdTe, CdZnTe, or HgCdZnTe. The impurities are extracted by furnishing a sink medium comprising molten bismuth, and contacting the contaminated structure to the sink medium for a period of time sufficiently long that impurities diffuse out of the structure and into the bismuth for removal. The molten bismuth may additionally contain small amounts of one or more of the major components of the structure (mercury, cadmium, zinc, and/or tellurium) to inhibit loss of these elements from the structure.

19 Claims, 2 Drawing Sheets

EXTRACTION OF IMPURITIES FROM STRUCTURES CONTAINING MERCURY, CADMIUM, ZINC, OR TELLURIUM, AND IMPURITIES

This invention relates to semiconductor structures such as infrared sensors, and, more particularly, to improving their operation by removing impurities therein which result from device fabrication.

BACKGROUND OF THE INVENTION

A common physical configuration for many types of microelectronic devices, such as sensors and electronic circuitry, is a thin-film device deposited upon a substrate. The thin film device is formed of at least one layer of a semiconductor material having properties useful for the particular application, deposited upon the substrate. For optical sensors, the semiconductor material converts incident light to an electrical current. For electronic circuitry, the semiconductor material serves as the base for fabrication of active elements such as transistors as well as passive elements.

The optical and electrical performance of semiconductor materials is highly dependent upon elements present in the material in relatively small amounts. Some such minor elements, generally called dopants, are intentionally added to alter the performance in favorable and controllable ways. Other such minor elements are unintentionally present as a result of the fabrication of the device. If the structure is grown from the melt, impurities in the molten material may be frozen into the solidified semiconductor material. If the structure is deposited by a technique such as vapor deposition, impurities from the atmosphere, the substrate, or the source material may be co-deposited. In any case, the impurities create defects which alter the performance of the thin-film semiconductor device in an uncontrollable manner by mechanisms such as recombination, trapping, and tunneling.

Care is taken to minimize the presence of impurities during fabrication of the structure. However, it is not possible to achieve, by current fabrication techniques, sufficiently low concentrations of impurities for some applications in as-fabricated structures. Methods have therefore been developed to extract impurities from contaminated structures, after they are prepared. In some cases the extraction of impurities is quite difficult. Mobile impurities such as lithium, sodium, potassium, and copper may be removed from CdZnTe or CdTe by contacting the structure to molten potassium cyanide at temperatures greater than 634.5° C. This technique is both potentially hazardous to practice due to the presence of cyanide and also requires quite a high temperature that is not suitable for many other semiconductor materials. All-solid processes have been attempted, such as the deposition of a sacrificial layer on a semiconductor layered structure. For example, a sacrificial layer of polycrystalline CdTe may be deposited on the surface of a HgCdTe layer, and the composite structure heated to the range of 200–400° C. The objective is that impurities diffuse from the HgCdTe layer into the CdTe layer, and the CdTe layer is later removed. This technique has not proved to be successful. In a separate approach to altering properties of semiconductor structures, wash melts are sometimes used as part of the deposition and growth process. The wash melts are used to clean and etch the surface of the substrate, but are not contacted to the substrate for a sufficiently long time to extract impurities.

There is a need for a technique by which mobile impurities may be removed from structures such as thin-film semiconductor devices, particularly those containing mercury, cadmium, zinc, and/or tellurium as principal constituents. The present invention fulfills this need, and further provides related benefits.

SUMMARY OF THE INVENTION

The present invention provides a method for extracting impurities from contaminated thin-film structures whose principal constituents include mercury, cadmium, zinc, and/or tellurium. Examples of such materials include HgCdTe, CdTe, CdZnTe, and HgCdZnTe, all of which are substrate materials or infrared-sensitive detector materials. (Hg refers to mercury, Cd refers to cadmium, Zn refers to zinc, and Te refers to tellurium.) Contamination of such materials by impurities such as lithium, sodium, potassium, and copper adversely affect their performance, and the levels of such impurities cannot be reduced sufficiently by common fabrication procedures. The present invention provides for the removal of such impurities efficiently and at relatively low cost. It is accomplished at a sufficiently low contacting temperature to be suitable for extraction of impurities from materials such as the mercury-containing compounds HgCdTe and HgCdZnTe. The method does not require complex equipment, is safe, and is easy to practice. Variations of the basic method ensure that the principal constituents are not depleted.

In accordance with the invention, impurities are extracted from a contaminated thin-film structure comprising a constituent element selected from the group consisting of mercury, cadmium, zinc, and tellurium, and mixtures thereof, and having impurities therein. The method includes preparing a sink medium comprising molten bismuth and contacting the contaminated structure to the sink medium for a period of time of at least about 10 minutes.

In another embodiment, the method includes the step of preparing a sink medium comprising molten bismuth and at least one added constituent element selected from the group consisting of mercury, cadmium, zinc, and tellurium, and mixtures thereof. The step of preparing includes the substeps of furnishing bismuth, furnishing the at least one added constituent element from a source other than the contaminated thin-film structure, and mixing the at least one added constituent element and the bismuth together. The contaminated thin-film structure and the sink medium are contacted together for a period of time. The "constituent elements" of the contaminated structure are the elements which are desirably in the structure, and are to be maintained without a change in chemical composition. The "impurity elements" those which contaminate the contaminated structure and are to be extracted. Their chemical concentration is to be reduced.

The step of contacting is preferably performed at a contacting temperature of from about 275° C. to about 325° C. The period of time is preferably from about 10 minutes to about 48 hours.

The step of furnishing a sink medium may include the step of providing a bath of the sink medium comprising molten bismuth and mercury, under an inert atmosphere having an atmospheric concentration of mercury therein.

In one preferred embodiment, a method for extracting impurities is operable with a thin-film contaminated device including a principal constituent selected from the group consisting of mercury, cadmium, zinc, and tellurium, and mixtures thereof, and having impurities therein. The contaminated device comprises a layer structure with a thickness of no more than about 200 micrometers, preferably from about 5 to about 50 micrometers, and most preferably about 20 micrometers. Some layer structures of particular interest are the layer structures comprising at least one layer selected from the group consisting of HgCdTe, CdTe, CdZnTe, and HgCdZnTe. The method includes furnishing a sink medium comprising molten bismuth, and contacting the contaminated device to the sink medium for a period of time. This contacting at elevated temperature causes mobile impurities such as lithium, sodium, potassium, and copper to diffuse through the thin-film device to the free surface, and to transfer to the molten sink medium, which thereby serves as a diffusion sink for the impurities.

In one embodiment, the layer structure comprises at least two constituent elements, and the step of furnishing includes the step of furnishing the sink medium comprising molten bismuth and at least one of the constituent elements of the layer structure. At least one of the two principal constituent elements may be selected from the group consisting of mercury cadmium, zinc, and tellurium. Desirably, the element with the highest vapor pressure would be present in the sink medium. If the layer structure comprises mercury, the sink medium may further comprise mercury; if the layer structure comprises cadmium, the sink medium may further comprise cadmium; if the layer structure comprises zinc, the sink medium may further comprise zinc; if the layer structure comprises tellurium, the sink medium may further comprise tellurium; if the layer structure comprises two or more of these principal constituent elements, the sink medium may comprise each of the principal constituent elements that is present. The higher the vapor pressure of the constituent element, the more preferable that it be included in the sink medium to reduce loss of the element from the layer structure.

The contacting of the contaminated thin-film device to the sink medium is preferably accomplished by providing a bath of the sink medium at the desired contacting temperature of no less than the melting point of the sink medium. The sink medium is primarily molten bismuth, but it may contain small amounts of one or more of the primary constituent elements. The bath is desirably covered by a chemically inert vapor of a gas such as argon, helium, or nitrogen, or a reducing gas such as hydrogen. One or more of the primary constituents of the layer structure may also be present in the vapor. The presence of the primary constituent elements in the sink medium and in the atmosphere increases their chemical activity so that there is less tendency for the diffusional loss of the primary constituents from the thin-film device into the sink medium. The thin-film device is immersed into the sink medium for a sufficient period of time to reduce the impurity content(s) to the desired level(s).

The present approach uses bismuth as the primary component of the sink medium. Bismuth has a relatively low melting point, so that the contacting temperature may be sufficiently low that the method is practical for use with mercury-containing layer structures and other structures where interdiffusion and/or loss of the principal constituents is a concern. The contacting temperature may be sufficiently high that the mobile impurities diffuse at acceptably high rates and the extraction may be accomplished in commercially practical times. Molten bismuth also dissolves mercury in acceptable amounts to provide the activity increase discussed above.

The present invention thereby achieves extraction of impurities from a contaminated thin-film structure without adversely affecting the thin-film structure itself. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
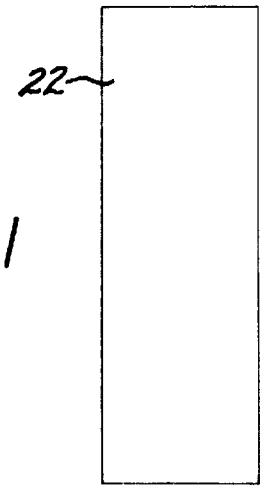
FIG. 1 is an elevational view of a substrate.
Figure 2:
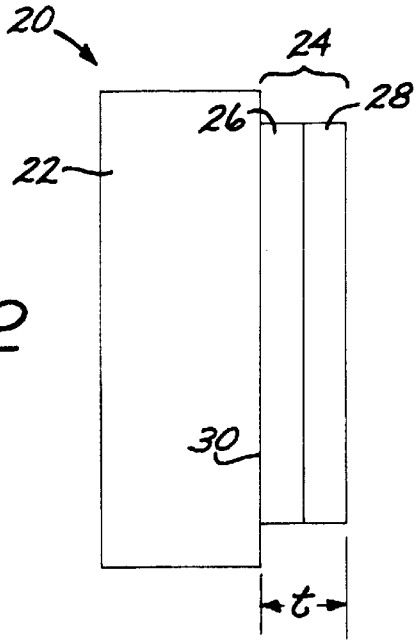
FIG. 2 is an elevational view of a thin-film device deposited upon a substrate.
Figure 4:
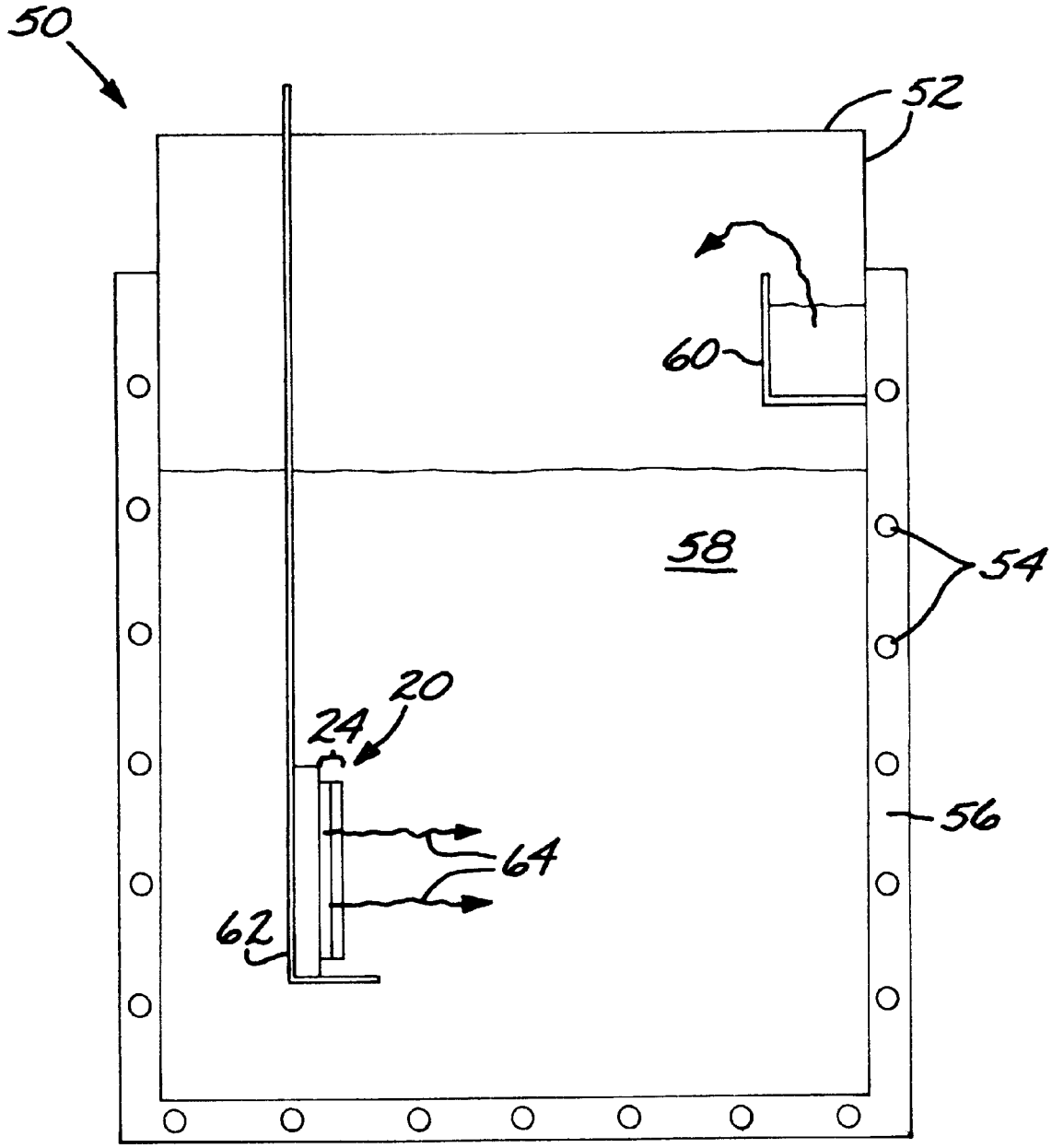
FIG. 4 is a schematic sectional view of an apparatus for practicing the present invention.

FIG. 1 illustrates a substrate, and FIG. 2 illustrates a structure 20 that may be processed by the present approach. (FIGS. 1, 2, and 4 are not drawn to scale.) The structure of FIG. 1 includes a device substrate 22, and the structure 20 of FIG. 2 includes a thin-film structure in the form of a thin-film device 24 deposited upon the device substrate 22.

The device substrate 22 preferably comprises a constituent element selected from the group consisting of mercury, cadmium, zinc, and tellurium, and mixtures thereof. Examples of such device substrates include CdTe and CdZnTe. (Symbology such as "CdTe" is meant to indicate the elements present, and is not limited to a specific equiatomic composition.) The device substrate may be of any operable thickness, but is typically from about 0.3 to about 3 millimeters, most preferably about 1 millimeter.

FIG. 2 depicts the thin-film device 24 deposited upon or grown upon the substrate 22. The thin-film device 24 may be of any operable type, but generally is formed from one or more relatively thin layers of a semiconductor material comprising a constituent element selected from the group consisting of mercury, cadmium, zinc, and tellurium, and mixtures thereof. Examples of such semiconductor materials include HgCdTe, CdTe, CdZnTe, and HgCdZnTe, which may be intentionally doped to yield specific optical and/or electronic performance. The thin-film device 24 is here depicted as having two layers 26 and 28, but it may have only a single layer or it may have more than two layers. The thin-film device 24 is preferably deposited epitaxially on a top surface 30 of the substrate 22, as by a vapor deposition process, although the present approach is operable even when the contact between the thin-film device 24 and the substrate 22 is not epitaxial. The thin-film device 24 typically has a thickness t of no more than about 200 micrometers, preferably from about 5 to about 50 micrometers, and most preferably about 20 micrometers.

The thin-film device 24 is initially contaminated with an impurity element such as lithium, sodium, potassium, and/or copper, or mixtures thereof. The impurities are usually present in small amounts such as from about 10 parts per billion (ppb) by weight to about 10,000 parts per billion by weight. Even these small amounts of the impurity elements may adversely affect the performance of the thin-film device 24. Such small concentrations of impurities may be deposited into the thin-film device 24, or they may diffuse into the thin-film device 24 from the substrate 22, in either case producing adverse effects on the optical and/or electronic performance of the thin-film device 24. The present invention deals with the reduction of the impurity elements to acceptably low levels in the thin-film device 24.

Figure 3:
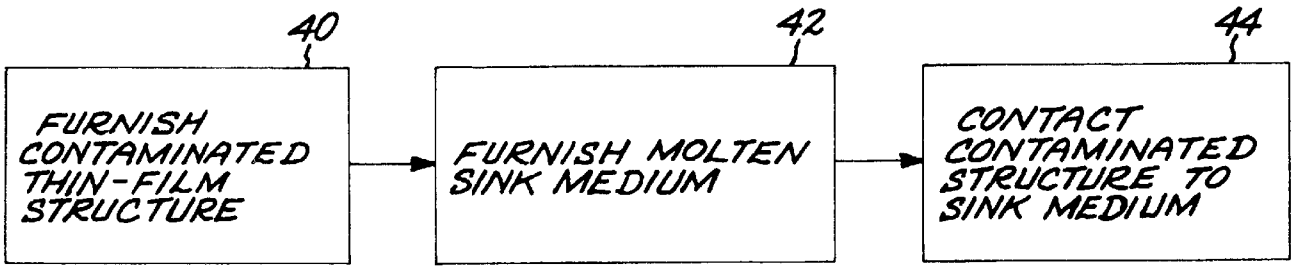
FIG. 3 is a block flow diagram of an approach for practicing the present invention.

FIG. 3 depicts an approach for the extraction and removal of the impurities from the device. The contaminated thin-film device 24, such as that described above, is furnished, numeral 40.

A molten sink medium is provided, numeral 42. The term "sink medium" is used in the sense of a diffusion sink, a low-chemical-activity reservoir for impurities diffused out of and from the contaminated structure 20. The molten sink medium comprises the element bismuth (Bi). It may comprise other elements as well. It may optionally comprise additions of the same constituent elements as found in the contaminated thin-film device 24. The contaminated thin-film device 24 typically is formed of elements including mercury, cadmium, zinc, and/or tellurium in the applications of interest to the inventors. Examples include HgCdTe, CdTe, CdZnTe, and HgCdZnTe. The presence of these added constituent elements in the molten sink medium, furnished from a source other than the contaminated thin-film device structure itself, increases the chemical activity of the molten sink medium for each added constituent element, relative to the chemical activity in the contaminated thin-film device 24. (The added constituent elements are furnished from a source other than the contaminated structure, because furnishing them from the contaminated structure would produce a change in the chemistry of the desired constituent elements of the contaminated structure.) Desirably, the chemical activity of the added constituent element would be about the same as the chemical activity of the constituent element in the contaminated thin-film device 24, so that there is no out-diffusion and resulting depletion of the constituent element from the contaminated thin-film device 24 into the molten sink medium. It is desired to extract the impurity elements with no other change in the chemical composition of the contaminated thin-film device 24. Typically, each added constituent element in the molten sink medium is present in an amount of from about 0.1 to about 1.0 percent by weight.

The contaminated thin-film device 24 and the molten sink material are contacted together, numeral 44 of FIG. 3. Any operable contacting approach may be used. A preferred form of a contacting apparatus 50 is illustrated in FIG. 4. A closed vessel 52 is heated by a resistance heater 54 and insulated by an insulator material 56. The interior of the vessel 52 contains a bath 58 of the molten sink medium, which is melted and maintained at temperature by the resistance heater 54. The molten sink medium comprises bismuth and one or more added constituent elements. Any added constituent elements may be melted into the molten bath prior to or after beginning the contacting step. The addition may be continuous. In the contacting apparatus 50 of FIG. 4, a heated source 60 of one of the added constituent elements, here illustrated as mercury, is placed above the surface of the bath 58. Mercury is continuously evaporated from the source 60 and into the atmosphere above the bath 58 as an overpressure of mercury, and thence into the bath 58 itself.

The contaminated thin-film device 24 is supported on a holder 62 and immersed into the bath 58 of the molten sink medium. Impurities diffuse out of the contaminated thin-film device 24 and into the molten sink medium, as indicated schematically by arrows 64, because the concentration and the chemical activity of the impurities are necessarily higher in the contaminated thin-film device structure than in the molten sink medium.

The temperature of the bath 58 during the contacting step 44 and the time period of contacting are selected to be compatible with the contaminated structure 20 and the desired degree of removal of the impurities. The temperature of the bath 58 must be less than the melting point of any of the parts of the contaminated structure 20. In the case of a mercury-containing contaminated structure 20 such as one having layers of HgCdTe and/or HgCdZnTe, the preferred contacting temperature is from about 275° C. to about 325° C. In the case of CdTe, where mercury is not present, the preferred contacting temperature is from about 500° C. to about 800° C., most preferably from about 500° C. to about 600° C. The diffusion temperature within the contaminated structure 20 is established by the temperature of the bath 58, because of the much larger thermal mass of the bath 58.

The duration of the contacting time must be sufficient to permit the diffusion of the impurities out of the contaminated thin-film device structure. The time required depends upon the thickness of the contaminated structure and the temperature of the bath 58, upon the nature of the impurity, and upon how low the final impurity content must be. However, some generalizations may be stated. The contacting time must be at least about 10 minutes for any thickness of contaminated thin-film device structure that is practical. Shorter times achieve only a possible cleaning and etching of the surface of the contaminated structure, not the extraction of impurities that are in the interior of the contaminated structure. Desirably, the contacting time is at least about 60 minutes to permit full extraction. Extension of the contacting time beyond that required for full extraction is not helpful, and may adversely affect the structure of the device. A maximum contacting time of 48 hours is sufficient for applications known to the inventors, and a contacting time of 240 minutes is sufficient for most cases.

As the impurities diffuse out of the contaminated structure, it becomes increasingly less contaminated and eventually uncontaminated. The concentration of the impurities in the bath 58 increases. Because the bath 58 is much larger in volume than the contaminated structure, the increase in concentration of impurities in the bath is less than the reduction in concentration of impurities in the contaminated structure. The bath 58 may therefore typically be used for the impurity extraction from many contaminated structures.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for extracting impurities from a contaminated thin-film structure based on mercury, cadmium, zinc, or tellurium, comprising the steps of:

furnishing the contaminated thin-film structure comprising a constituent element selected from the group consisting of mercury, cadmium, zinc, and tellurium, and mixtures thereof, and having impurities therein;

preparing a sink medium comprising a molten bath of bismuth and at least one added constituent element selected from the group consisting of mercury, cadmium, zinc, and tellurium, and mixtures thereof, the step of preparing including the substeps of furnishing bismuth, furnishing the at least one added constituent element from a source other than the contaminated thin-film structure, and mixing the at least one added constituent element and the bismuth together; and immersing the contaminated structure into the molten bath of the sink medium for a period of time.

2. The method of claim 1, wherein the thin-film structure comprises a thin-film device comprising a layer structure and having a thickness of no more than about 200 micrometers.

3. The method of claim 2, wherein the layer structure comprises at least one layer selected from the group consisting of HgCdTe, CdTe, CdZnTe, and HgCdZnTe.

4. The method of claim 1, wherein the step of contacting is performed at a contacting temperature of from about 275° C. to about 325° C.

5. The method of claim 1, wherein the period of time is from about 10 minutes to about 48 hours.

6. The method of claim 1, wherein the step of furnishing a sink medium includes the step of providing the molten bath of the sink medium comprising molten bismuth and mercury, under an inert atmosphere having an atmospheric concentration of mercury therein.

7. A method for extracting impurities from a contaminated thin-film structure based on mercury, cadmium, zinc, or tellurium, comprising the steps of:

furnishing the contaminated thin-film structure comprising a thin-film device deposited upon a device substrate and comprising a constituent element selected from the group consisting of mercury, cadmium, zinc, and tellurium, and mixtures thereof, and having impurities therein;

preparing a sink medium of a molten bath comprising molten bismuth; and immersing the contaminated structure into the molten bath of the sink medium for a period of time of at least about 10 minutes.

8. The method of claim 7, wherein the period of time is at least about 60 minutes.

9. The method of claim 7, wherein the period of time is from about 10 minutes to about 240 minutes.

10. The method of claim 7, wherein the step of contacting is performed at a contacting temperature of from about 275° C. to about 325° C.

11. A method for extracting impurities from a thin-film contaminated device based on mercury, cadmium, zinc, or tellurium, comprising the steps of:

furnishing the thin-film contaminated device comprising an element selected from the group consisting of mercury, cadmium, zinc, and tellurium, and having impurities therein, the contaminated device comprising a layer structure with a thickness of no more than about 200 micrometers;

furnishing a sink medium comprising molten bismuth; and contacting the contaminated device to the sink medium for a period of time.

12. The method of claim 11, wherein the layer structure has a thickness of from about 5 micrometers to about 50 micrometers.

13. The method of claim 11, wherein the layer structure comprises at least two constituent elements, and wherein the step of furnishing includes the step of furnishing the sink medium comprising molten bismuth and at least one of the constituent elements of the layer structure.

14. The method of claim 11, wherein the layer structure comprises at least one layer selected from the group consisting of HgCdTe, CdTe, CdZnTe, and HgCdZnTe.

15. The method of claim 11, wherein the step of contacting is performed at a contacting temperature of from about 275° C. to about 325° C.

16. The method of claim 11, wherein the step of furnishing the sink medium includes the step of furnishing the sink medium comprising molten bismuth and mercury.

17. The method of claim 11, wherein the step of furnishing the sink medium includes the step of furnishing the sink medium having about the chemical activity of each added element selected from the group consisting of mercury, cadmium, zinc, and tellurium that is present in the thin-film contaminated device.

18. A method for extracting impurities from a thin-film contaminated device based on mercury, cadmium, zinc, or tellurium, comprising the steps of:

furnishing the thin-film contaminated device having impurities therein, the contaminated device comprising a layer structure having at least one layer selected from the group consisting of HgCdTe and HgCdZnTe;

furnishing a sink medium comprising molten bismuth and mercury, under an inert atmosphere having an atmospheric concentration of mercury therein; and contacting the contaminated device to the sink medium for a period of time.

19. The method of claim 18, wherein the sink medium further includes at least one element selected from the group consisting of cadmium, zinc, and tellurium.

* * * * *